US005163401A

United States Patent [19]

Reese

[11] Patent Number: 5,163,401

[45] Date of Patent: Nov. 17, 1992

[54] OVERRIDE SPEED CONTROL SYSTEM

[75] Inventor: Paul T. Reese, New Holstein, Wis.

[73] Assignee: Tecumseh Products Company, Tecumseh, Mich.

[21] Appl. No.: 811,542

[22] Filed: Dec. 20, 1991

[51] Int. Cl.[5] ..... F02D 31/00

[52] U.S. Cl. ..... 123/376; 123/377; 123/352

[58] Field of Search ..... 123/376, 377, 352, 396

[56] References Cited

U.S. PATENT DOCUMENTS

| | | | |
|---|---|---|---|
| 3,704,635 | 12/1972 | Eshelman | 74/482 |
| 4,108,120 | 8/1978 | Woelffer | 123/103 B |
| 4,117,809 | 10/1978 | Kittler | 123/98 |
| 4,217,867 | 8/1980 | Madsen et al. | 123/352 |
| 4,453,517 | 6/1984 | Kasiewicz | 123/352 |
| 4,490,309 | 12/1984 | Fujikawa et al. | 261/52 |
| 4,517,942 | 5/1985 | Pirkey et al. | 123/376 |
| 4,531,489 | 7/1985 | Sturdy | 123/376 |
| 4,543,932 | 10/1985 | Sturdy | 123/376 |
| 4,712,443 | 12/1987 | Deane | 74/470 |
| 4,773,371 | 9/1988 | Stenz | 123/376 |
| 4,860,608 | 8/1989 | Kobayashi | 74/501.6 |
| 4,889,093 | 12/1989 | Nishiyama et al. | 123/400 |

*Primary Examiner*—E. Rollins Cross
*Assistant Examiner*—M. Macy
*Attorney, Agent, or Firm*—Baker & Daniels

[57] ABSTRACT

An override speed control mechanism for an internal combustion engine. The override speed control system comprises a speed control lever that is movable by an operator within an actuation range having a lower control limit and an upper control limit. A throttle control mechanism is connectable to the carburetor to actuate the throttle plate of the carburetor. A coupling lever is detachably coupled to the speed control lever and the throttle control mechanism. The throttle control mechanism is caused to move through its entire operating range in response to movement of the speed control lever through a predetermined partial portion of its actuation range. The effective range of the speed control lever corresponds to the operating range of the throttle control mechanism, and movement of the speed control lever between the lower override limit and the lower control limit, and between the upper override limit and the upper control limit is ineffective to further move the throttle control mechanism.

17 Claims, 4 Drawing Sheets

OVERRIDE SPEED CONTROL SYSTEM

BACKGROUND OF THE INVENTION

The present invention relates generally to carburetor control systems for internal combustion engines and, more particularly, to an improved override speed control system for a carburetor of a small internal combustion engine.

In many uses of internal combustion engines, it is desirable that the engine be controlled so that its speed remains relatively constant under different loading conditions. For instance, in the use of the engine to power a lawn mower, it is desirable that the speed of the engine selected by an operator remain relatively constant whether the lawn mower encounters tall or short grass. This function is accomplished by means of three elements which are common to most engines of the type revealed herein. The three elements are a governor, a governor spring, and a speed control system. These three elements are interconnected with one another and with the carburetor throttle by a system of levers and wire links.

The governor generates a force which is proportional to the speed of the engine. The governor is connected to the carburetor throttle through a governor lever and governor link. The governor force biases the carburetor throttle toward closed position. The governor spring is connected to the governor lever and, when stretched to a length greater than its free length, it produces a force that biases the throttle lever toward open position.

The speed control system serves to modulate the length of the governor spring and thereby modulate its prevailing spring force. When the engine is not running, any force in the governor spring will pull the carburetor throttle to wide open position. As the engine accelerates, the governor force will reach a level that equals or exceeds the prevailing governor spring force. The governor will thereby overpower the governor spring and rotate the governor lever toward closed throttle position. As the governor lever rotates toward the closed throttle position, the governor spring suffers a slight extension of length and, therefore, a slight increase of its prevailing force. Eventually a spring length and corresponding force is reached that just equals the prevailing governor force. This equilibrium point establishes a carburetor throttle position that is appropriate to maintain the proper engine speed at the prevailing engine load. If the engine load increases, the engine will slow down slightly. This allows the governor spring to contract slightly in order to maintain equilibrium with the governor force thus increasing the throttle opening.

One override speed control system for the carburetor of a small internal combustion engine, such as used on a lawn mower, is disclosed in U.S. Pat. No. 4,517,942, issued to Pirkey et al., which is assigned to the assignee of the present invention. The control system of this patent basically includes a speed control lever, an intermediate speed override lever, and a throttle control of governor lever. The three levers are interconnected by a pair of extension springs, one of which extends between and connects the intermediate lever and the speed control lever spaced from it in one direction. The other extension spring extends between and connects the intermediate lever and the governor lever spaced from it in the opposite direction.

The speed control system maintains a constant engine speed for any setting of the speed control lever. When the speed control lever is in its last increment of movement, it actuates the choke valve of the carburetor. The intermediate lever is unresponsive to the control lever in its last increment of movement. Thus, the speed setting of the engine will remain constant irrespective of the choking action of the speed control lever. The governor maintains control over the engine speed under varying load conditions from the idle setting through the choke setting of the speed control lever. The setting of the speed control lever is selected by the operator through pivotal actuation of a hand lever, which is connected to the speed control lever by a control cable.

Speed adjustment is customarily accomplished by means of adjustment screws that limit the motion of the intermediate speed override lever. Override is accomplished by a torsion spring that biases the speed control lever and the intermediate lever against a common stop that establishes an angular relationship between the two levers. At the point of speed setting established by the speed set screw, the intermediate lever motion stops, but the speed control elver can continue in motion as the stop points separate and the torsion spring winds up. This provides override capability in only one direction, traditionally beyond the high speed set point.

It is desired to provide expanded override capability as well as a different arrangement of the components of the speed control system for more efficient override speed control action.

SUMMARY OF THE INVENTION

The present invention provides an override speed control system for controlling a carburetor in an internal combustion engine wherein the speed control lever moveable by an operator and the throttle control lever that is connectable to the carburetor are coupled such that the throttle control lever is caused to move through its entire operating range in response to movement of the speed control lever through a predetermined partial portion of its actuation range so that movement of the speed control lever between its lower override limit and lower control limit and between its upper override limit and its upper control limit is ineffective to further change the length of the governor spring.

The invention provides a speed regulating apparatus for an internal combustion engine having a movable throttle valve, the position of which affects the speed and power output of the engine. The position of the throttle valve is controlled by a mechanical output of a mechanical proportional controller or governor, whereby the mechanical output is balanced by a contravening force produced by the governor spring. A speed control lever is operatively connected to the output lever of the governor and is movable by an operator within a certain actuation range. The speed control elver has a lower control limit and an upper control limit and is coupled to a coupling lever, which is itself detachably coupled to a rigid link that is attached to the governor lever by a resilient spring. The rigid link has an operating range of motion which corresponds to a partial portion of the actuation range, or the effective range of motion, of the speed control lever. This effective range of motion has a lower override limit and an upper override limit. Movement of the speed control lever between the lower control limit and the lower override limit occurs as the coupling lever is detached from the rigid link so that such movement is ineffective to further move the rigid link. Likewise, movement of the speed control lever between the upper control limit and the upper override limit results in the speed control lever being detached from the coupling lever so that such movement is ineffective to further move the rigid link.

An advantage of the override speed control system of the present invention is that override capability is provided beyond the low speed set point as well as beyond the high speed set point in conjunction with a governed low speed and a governed high speed.

Another advantage of the override speed control system of the present invention is that the use of set screws are eliminated, and bendable levers are utilized which are more efficient and easier to adjust.

Yet another advantage of the override speed control system of the present invention is that a range of tolerance accommodation is provided beyond both the low speed setting and the high speed setting to permit efficient installment of a Bowden wire system.

The present invention, in one form thereof, provides an override speed control system for controlling a carburetor in an internal combustion engine. The system includes a speed control lever and a throttle control mechanism. The speed control lever is moveable by an operator within an actuation range having a lower control limit and an upper control limit. The speed control is connected to the throttle control through the governor spring. The throttle control mechanism is connectable to the carburetor to actuate the throttle plate of the carburetor in response to movement of the throttle control mechanism within an operating range having a lower operating limit and an upper operating limit. The speed control elver and the throttle control mechanism are coupled together through the governor spring such that extension of the governor spring causes the throttle control mechanism to move through its entire operating range in response to movement of the speed control lever through a predetermined partial portion of its actuation range. The predetermined portion defines an effective range of motion having a lower override limit and an upper override limit that differs from the lower control limit and the upper control limit, respectively. The effective range of the speed control lever corresponds to the operating range of the throttle control mechanism, and movement of the speed control lever between the lower override limit and the lower control limit, and between the upper override limit and the upper control limit is ineffective to further extend or contract the governor spring.

DESCRIPTION OF THE PREFERRED EMBODIMENT

Figure 1:
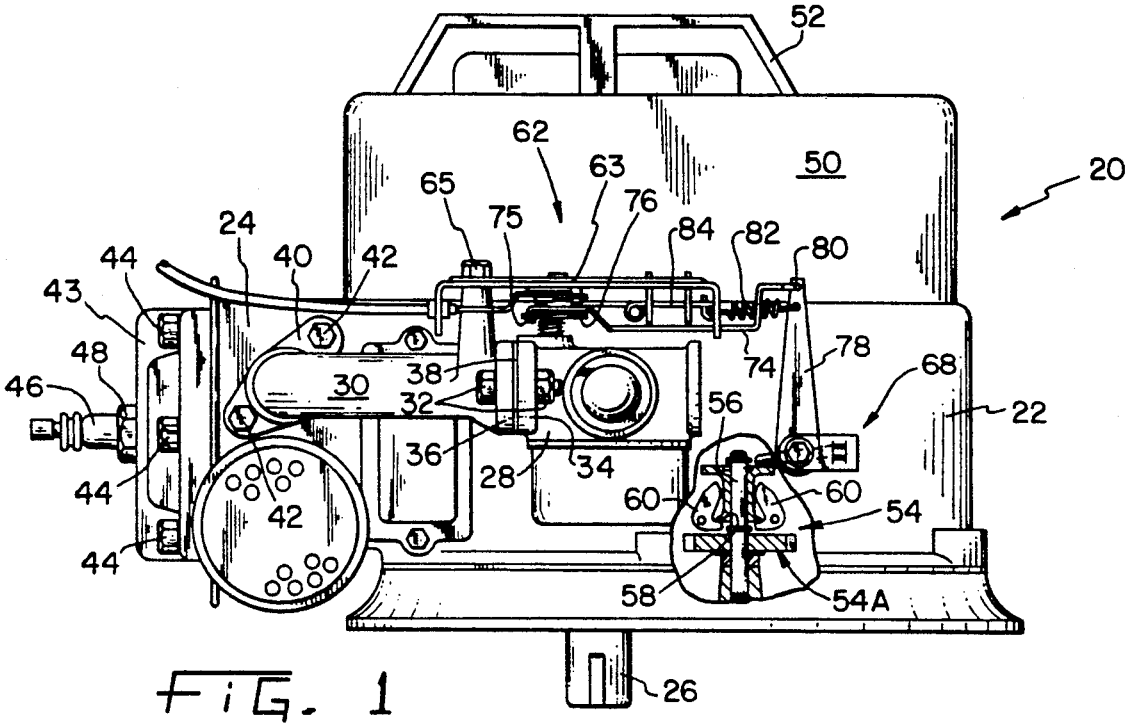
FIG. 1 is an elevational view of a small internal combustion engine, with portions broken away to show the override speed control system of the present invention mounted therein.

Referring to the drawings, and particularly to FIG. 1, there is shown a single cylinder, air-cooled, vertical crankshaft engine 20 of the type adapted for mounting on the deck of a rotary lawn mower. Engine 20 includes a crankcase 22 and a cylinder block 24 which are cast as an integral unit. Crankcase 22 houses and supports a vertically oriented crankshaft 26. A piston (not shown), which is mounted for reciprocal movement within the cylinder (not shown) in engine block 24, is operatively connected to crankshaft 26 through a connecting rod (not shown). A carburetor 28 is attached to intake manifold 30 by a pair of fasteners 32 which secure a flange 34 at the outlet end of carburetor 28 to a mounting flange 36 on intake manifold 30. A gasket 38 seals the connection between flanges 34 and 36. The other end of intake manifold 30 includes a mounting flange 40 for mounting the end to cylinder block 24 by fasteners 42. A cylinder head 43 is bolted to cylinder block 24 by bolts 44. A spark plug 46 is secured in cylinder head 43 by a bolt 48. Above these components of engine 20 are a blower housing 50 and a gravity feed fuel tank (not shown) above which is starter housing 52 from which extends a pole handle (not shown) attached to a flywheel pulley (not shown). The remaining components of engine 30 are well known and consequently are omitted for the sake of clarity in the following description.

A governor 54 is provided in crankcase 22, as shown in FIG. 1, and includes a conventional spool member 56 having a flange 58 which is engaged by flyweights 60. Flyweights 60 and spool 56 rotate together with a gear 54A which is driven in a well-known manner by any speed responsive engine member such as an engine camshaft timing gear. In general, carburetor 28 and governor 54 are substantially identical to the ones disclosed in detail in U.S. Pat. No. 4,517,942, issued to Pirkey, et al., which is assigned to the assignee of the present invention, and which is incorporated herein by reference. Therefore, these components need not be described in detail herein.

Figure 2:
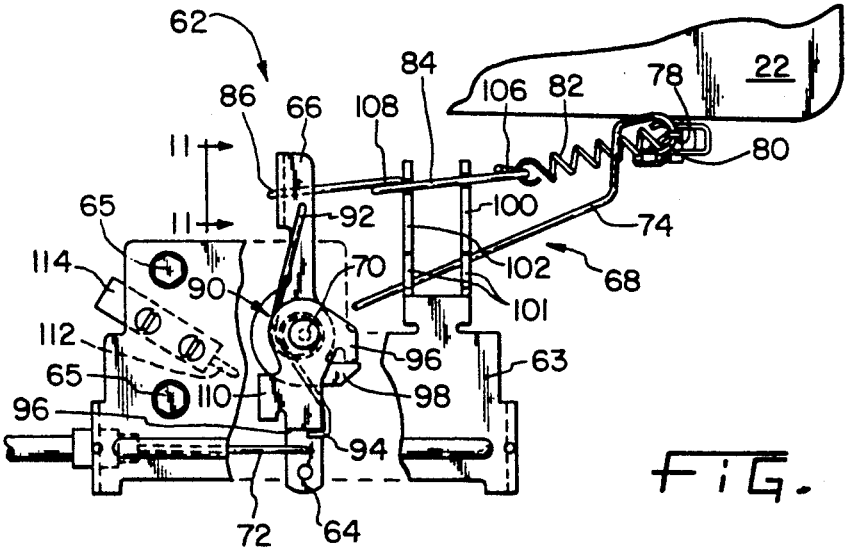
FIG. 2 is an enlarged fragmentary top view of the control system of FIG. 1, wherein the control system is in an idle or low speed position.
Figure 4:
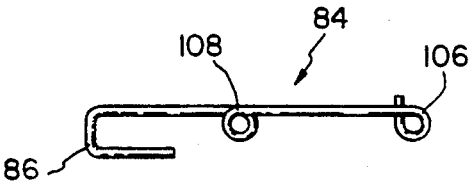
FIG. 4 is an enlarged isolated view of the rigid override link shown in FIG. 1.
Figure 11:
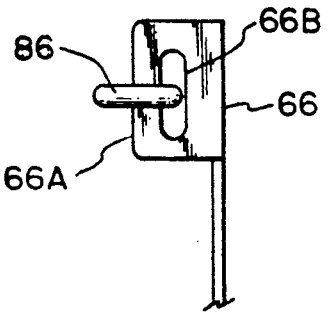
FIG. 11 is an enlarged end view of the coupling lever of FIG. 2 taken along line 11—11 in FIG. 2.
Figure 12:
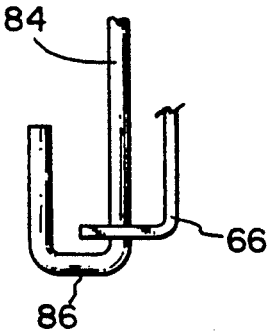
FIG. 12 is a top view of the coupling lever in FIG. 11.

Referring to FIGS. 1 and 2, there is shown an improved override speed control system, generally designated by the numeral 62 and constituting a preferred embodiment of the present invention. A plate 63 that is mounted by bolts 65 in upright fashion on crankcase 22 supports speed control system 62 in spaced relation from carburetor 28. A speed control lever 64 and a coupling lever 66 are pivotally mounted to plate 63. In addition, a throttle control mechanism is provided and generally designated at 68. Throttle control mechanism 68 broadly includes the governor system and other elements to be described herein. More particularly, throttle control mechanism 68 includes a throttle control rod 74 having one end 75 that is bent over and threaded through an opening in throttle plate 76 of carburetor 28. Throttle plate 76 includes a valve (not shown) for varying the amount of air-fuel mixture delivered to the cylinder. The opposite end of throttle control rod 74 is connected to a governor leer 78 by means of a bent over portion 80 that is threaded through an opening in governor lever 78, as shown in FIG. 1. Governor lever 78 is also connected by means of an extension spring 82 to an override link 84. As shown in FIGS. 11 and 12, override link 84 includes a bent over portion 86 (FIG. 4) that is engaged in opening 66B in flange 66A of coupling lever 66.

Figure 10:
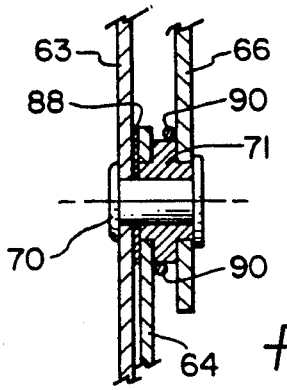
FIG. 10 is an enlarged sectional view of the control system of FIG. 9, taken along line 10—10 in FIG. 9.

Referring to FIGS. 2 and 10, speed control lever 64 is pivotally mounted to plate 63 adjacent a pivotable coupling lever 66 by a single rivet 70 that extends though bushing 71. Speed control lever 64 includes an opening therein, which engages a control cable 72, such as a Bowden cable. The control cable is connected with an implement control lever (not shown), which is typically mounted on the handle of a lawn mower or other device in a position where it can be conveniently moved by an operator. As best shown in FIG. 10, a flat washer 88 is disposed between plate 63 and speed control lever 64 to relieve friction therebetween. A torsion spring 90 is disposed about bushing 71 and includes a bent over end 92 that engages an opening in coupling lever 66. The opposite end 94 of spring 90 is bent under a shoulder portion 96 of speed control lever 64. As shown in FIG. 2, speed control lever 64 includes a radial projection 97 that is biased by spring 90 against a radial extension 98 of coupling lever 66.

Figure 5:
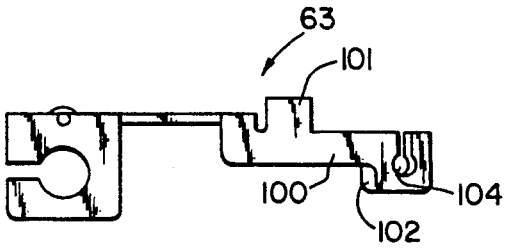
FIG. 5 is an enlarged isolated end view of the speed control plate shown in FIG. 1.

As shown in FIGS. 2 and 5, plate 63 includes a pair of bendable speed adjustment levers 100 and 102. Lever 102 is a low speed stop, and lever 100 is a high speed stop. Lever 102 limits movement of link 84 to a preset low speed position, and lever 100 limits movement of link 84 to a present high speed position. Each lever includes a projecting tab 101 for the reception of an adjusting tool (to be discussed hereinafter) and an opening 104 to permit a portion of link 84 to ride therebetween. As shown in FIG. 2, a "loop-shaped" stop portion or end 106, which is attached to spring 82 and a loop-shaped stop portion 108 are provided to limit linear movement of link 84 by abutment with either lever 100 or lever 102.

As will be described, the override system of the present invention essentially has five basic control lever settings or positions. These positions define the actuation range of speed control lever 64. The first setting is the "stop" position, in which speed control lever 64 is rotated far clockwise until shoulder 110 thereof engages switch arm 112 of kill switch 114. Upon such engagement, the primary winding of the ignition coil (not shown) is shorted out to prevent further engine firing as is conventional. In FIGS. 2, 6, 7, and 8, there are shown the remaining four engine speed positions.

In FIG. 2, control lever 64 is shown rotated slightly counterclockwise to its "low speed" position or "idle" position. As speed control lever 64 is moved to this position, coupling lever 66 is also moved across wire link 84 until it engages bent over portion 86. Loop 108 is still engaged by lever 102, as it was the "stop" position. Contact between loop 108 and lever 102 is established by tension in spring 82. As long as loop 108 is engaged against lever 102, link 84 exerts tension on spring 82, and hence governor lever 78, so that the "idle" speed is governed. The tension in spring 82 and hence the idle speed, is modulated by the adjustable position of lever 102.

Figure 6:
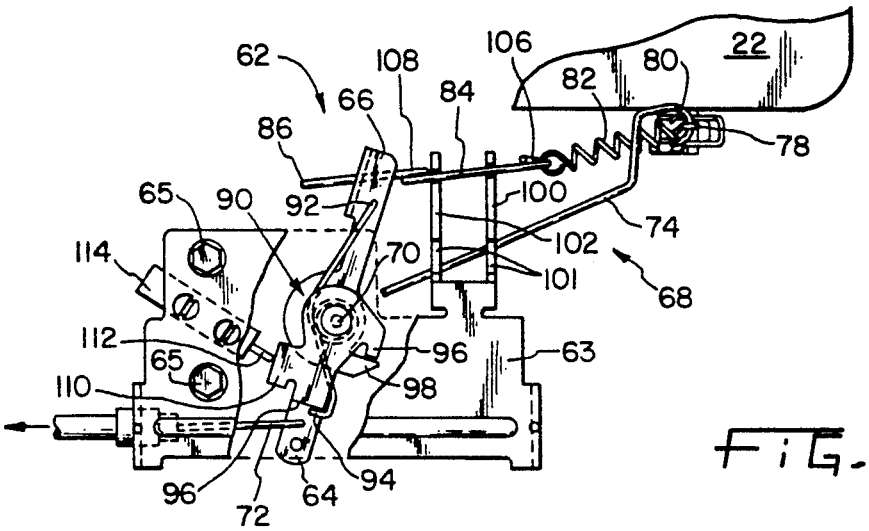
FIG. 6 is a view similar to FIG. 2, wherein the control system is in its low speed override position.

A particularly novel feature of the present invention is shown in FIG. 6, wherein speed control lever 64 is shown moved in the direction of the arrow so that it is positioned between its "stop" position and its "idle" position to provide low speed override. This low speed override feature permits some "play" between the "off" position and the "idle" position to compensate for tolerances in the Bowden wire system. As speed control lever 64 is moved, coupling lever 66 is detached from wire link 84 to permit lever 66 to slide along link 84 between loop 108 and bent over portion 86. It is noted that movement of speed control lever 64 from its "stop" position to its idle position is ineffective to move throttle control mechanism 68.

Figure 7:
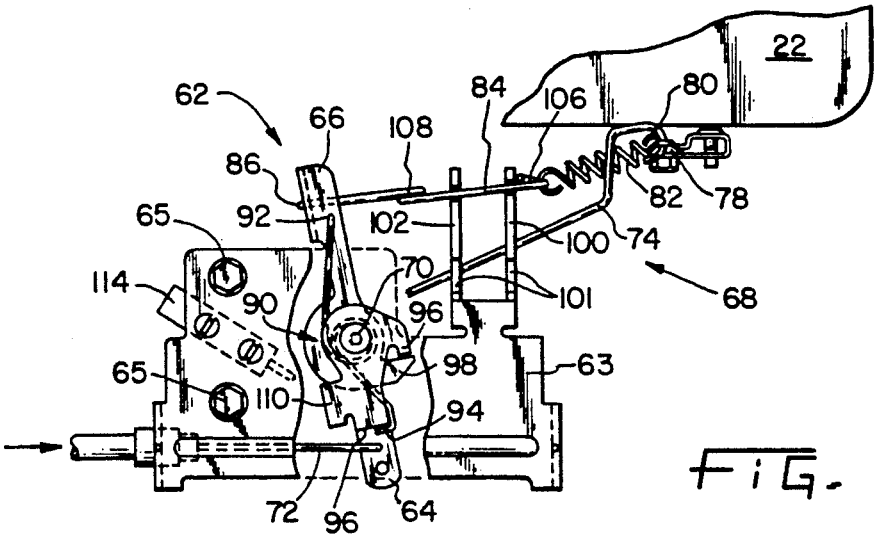
FIG. 7 is a view similar to FIGS. 2 and 6, wherein the control system is in its high speed position.

Referring now to FIG. 7, speed control lever 64 is rotated counterclockwise from its position shown in FIG. 2, in response to motion of control cable 72 as indicated by the arrow, to its high speed position. As lever 64 is moved, coupling lever 66 is also moved to pull loop 106 of wire link 84 into contact with high speed lever 100 and stretching spring 82. As spring 82 is stretched, the force it exerts on governor lever 78 increases. This increases the running speed of the engine by allowing throttle plate 76 to open. As the speed of the engine increases, the counteracting force produced by rotating flyweights 60 tends to rotate governor lever 78 in the clockwise direction as viewed in FIG. 1, thereby moving throttle control rod 74, which rotates throttle plate 76 to a more closed position. This more closed position is a position at which the tension of governor spring 82 is in equilibrium with the force generated by governor 54. The resulting throttle position is the appropriate position to maintain the desired speed at the prevailing load.

Figure 8:
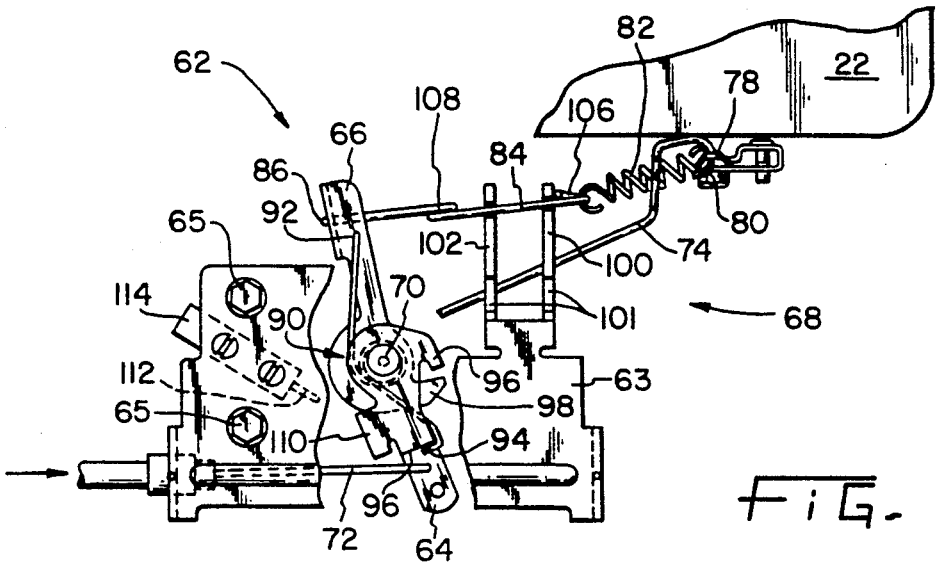
FIG. 8 is a view similar to FIGS. 2 and 6–7, wherein the control system is in its high speed override position.

Referring to FIG. 8, speed control system 62 is shown in its high speed override position, wherein speed control lever 64 is further rotated in the direction of the arrow to overcome the bias of spring 90, resulting in projection 96 of lever 64 being moved away from extension 98 of lever 66. Therefore, coupling lever 66 is detached from speed control lever 64 while in the high speed override position so that movement of lever 64 is ineffective to further extend governor spring 82.

It should be noted that high speed override is generally achieved at the point at which the input end of the speed control lever continues beyond the position at which the governor spring reaches its maximum set speed position. Often this is used for choking the engine because it is undesirable to permit the engine to continue speeding up while moving the speed control lever to the "choke" position since the speed limits of the engine would then be exceeded. In other words, override has traditionally been used to separate the high speed position from the choking position. However, the high speed override system of the present invention is designed to separate the high speed position from a range of tolerance accommodation.

Figure 3:
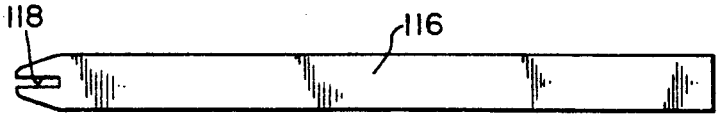
FIG. 3 is an elevational view of a speed setting adjustment tool of the present invention.
Figure 9:
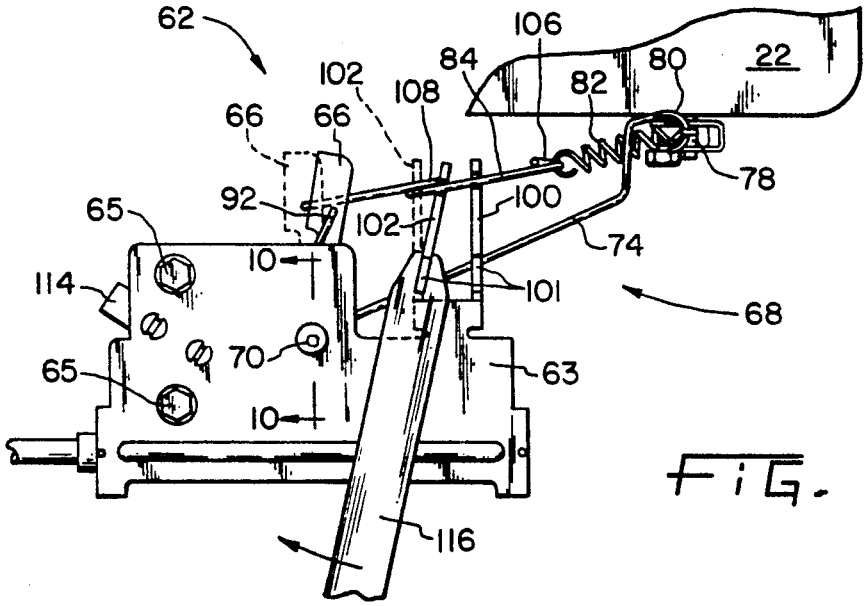
FIG. 9 is a back view of the governor device shown in FIG. 2, particularly showing the adjustment tool of FIG. 3 engaging a stop lever for speed setting adjustment.

Referring now to FIGS. 3 and 9, there is shown an adjusting tool including a slot 118 at one end thereof for adjusting the position of levers 100 and 102. As shown in FIG. 9, levers 100 and 102 are bendable to adjust the points at which the levers constrain the motion of override link 84, which in turn controls the stretched length of governor spring 82. In FIG. 9, slot 118 of tool 116 has been inserted onto tab 101 of lever 102 and rotated clockwise as indicated by the arrow to move lever 102 toward lever 100, thereby lowering the idle speed setting of the engine. Movement of lever 102 away from lever 100 increases the idle speed setting of the engine by increasing the tension on spring 82 while the engine is in its "idle" setting (FIG. 2) Similarly, movement of lever 100 toward lever 102 increases the high speed setting of the engine, and movement of lever 100 away from lever 102 decreases the high speed setting.

Although not shown, the carburetor may also include a choke valve, as is conventional. In this instance, the present invention provides considerable tolerance accommodation or high speed override, such as 300/1000 inch, between the high speed position and the full override position.

It will be appreciated that the foregoing is presented by way of illustration only, and not by way of any limitation, and that various alternatives and modifications may be made to the illustrated embodiment without departing from the spirit and scope of the invention.

What is claimed is:

1. An override speed control system for controlling a carburetor in an internal combustion engine, comprising:

a speed control lever movable by an operator within an actuation range having a lower control limit and an upper control limit;

a throttle control mechanism connectable to the carburetor to actuate a throttle plate of the carburetor in response to movement of the throttle control mechanism within an operating range having a lower operating limit and an upper operating limit; and coupling means for coupling said speed control lever and said throttle control mechanism such that said throttle control mechanism is caused to move through its entire operating range in response to movement of said speed control lever through a predetermined partial portion of its actuation range, said predetermined portion defining an effective range of motion having a lower override limit and an upper override limit differing from said lower control limit and said upper control limit, respectively, whereby said effective range of said speed control lever corresponds to said operating range of said throttle control mechanism, and movement of said speed control lever between said lower override limit and said lower control limit, and between said upper override limit and said upper control limit is ineffective to further move said throttle control mechanism.

2. The override speed control system according to claim 1, wherein said coupling means includes a coupling lever detachably coupled to said speed control lever and said throttle control mechanism, wherein said coupling lever is detached from said throttle control mechanism while said speed control lever is between said lower override limit and said lower control limit, and said coupling lever is detached from said spaced control lever while said speed control lever is between said upper override limit and said upper control limit.

3. The override speed control system according to claim 1, wherein said throttle control mechanism comprises a rigid link having a first stop means for stopping movement of said link in a first direction and a second stop means for stopping movement of said link in a second direction.

4. The override speed control system according to claim 3, including a speed control bracket having two spaced stop members positioned between and at generally right angles with respect to said first stop means and said second stop means, wherein movement of said ink in said first direction is stopped upon engagement of said first stop means with a first stop member and movement of said link in a second direction is stopped upon engagement of said second stop means with a second stop member.

5. The override speed control system according to claim 4, wherein each said stop member is bendable in a direction toward one of said first stop means and said second stop means.

6. The override speed control system according to claim 5, wherein a tool is introduced onto said stop lever for bending said stop lever.

7. The override speed control system according to claim 3, wherein said throttle control mechanism further comprises a governor lever, wherein said rigid link is connected to said governor lever by a resilient linkage.

8. In an internal combustion engine including a carburetor having a throttle, a speed regulating apparatus, comprising:

governor means mounted on the engine and driven thereby and responsive to engine speed, said governor means including an output lever;

a throttle control rod connected between said governor lever and the throttle for adjusting the throttle in accordance with engine speed;

a speed control lever movable by an operator within an actuation range having a lower control limit and an upper control limit;

a rigid link connectable to said governor lever by a resilient linkage means, wherein said throttle control rod actuates the throttle in response to movement of said link within an operating range having a lower operating limit and an upper operating limit; and coupling means for coupling said speed control lever to said rigid link such that said rigid link is caused to move through its entire operating range in response to movement of said speed control lever through a predetermined partial portion of its actuation range, said predetermined portion defining an effective range of motion having a lower override limit and an upper override limit differing from said lower control limit and said upper control limit, respectively, whereby said effective range of said speed control lever corresponds to said operating range of said rigid link, and movement of said speed control lever between said lower override limit and said lower control limit, and between said upper override limit and said upper control limit is ineffective to further move said rigid link.

9. The engine according to claim 8, wherein said coupling means includes a coupling lever detachably coupled to said speed control lever and said rigid link, wherein said coupling lever is detached from said rigid link while said speed control lever is between said lower override limit and said lower control limit, and said coupling lever is detached from said speed control lever while said speed control lever is between said upper override limit and said upper control limit.

10. The engine according to claim 8, wherein said rigid link includes a first stop means for stopping movement of said link in a first direction and a second stop means for stopping movement of said link in a second direction.

11. The engine according to claim 10, including a speed control bracket having two spaced levers positioned between and at generally right angles with respect to said first stop means and said second stop means, wherein movement of said link in said first direction is stopped upon engagement of said first lever with a first stop member and movement of said link in a second direction is stopped upon engagement of said second lever with a second stop member.

12. The engine according to claim 11, wherein each said stop lever is bendable in a direction toward one of said first stop means and said second stop means.

13. The engine according to claim 12, wherein a tool is introduced into one of said stop levers for bending said selected stop lever.

14. The engine according to claim 8, wherein said resilient linkage means is a spring.

15. In an internal combustion engine including a carburetor having a throttle, a speed regulating apparatus, comprising:

governor means mounted on the engine and driven thereby and responsive to engine speed, said governor means including an output lever;

a throttle control rod connected between said governor lever and the throttle for adjusting the throttle in accordance with engine speed;

a speed control elver movable by an operator for selecting engine speed;

a rigid throttle control link connectable to said governor lever, wherein said link actuates the throttle in response to movement of said link;

a low speed stop for engaging and limiting movement of said link to a preset low speed condition;

a first lost motion connection between said speed control lever and said link to permit said speed control lever to move past said low speed position without causing said link to move past said low speed position;

a high speed stop for engaging and limiting movement of said link to a preset high speed position; and a second lost motion connection between said speed control lever and said link to permit said speed control lever to continue moving past said high speed position into a choke position without causing said link to move past said high speed position.

16. The engine according to claim 15, wherein said low speed stop and said high speed stop are each movable to vary an engagement position of said link therewith.

17. A method of adjusting the minimum engine speed and the maximum engine speed of an internal combustion engine, including a carburetor, the method comprising the steps of:

providing a speed control lever movable by an operator, and a throttle control mechanism connectable to the carburetor to actuate a throttle plate of the carburetor in response to movement of said throttle control mechanism, said throttle control mechanism comprising a rigid link having a first stop means for stopping movement of said link in a first direction and a second stop means for stopping movement of said link in a second and opposite direction;

providing coupling means for coupling said speed control lever to said link, such that said link is caused to move in response to movement of said speed control lever;

providing a speed control bracket having two bendable spaced stop levers positioned between said first stop means and said second stop means, wherein movement of said link in said first direction is stopped upon engagement of said first stop means with a first stop lever to define an upper speed limit, and movement of said link in said second direction is stopped upon engagement of said second stop means with said second lever to define a lower speed limit;

introducing a tool onto one of said first stop lever and said second stop lever;

rotating said tool in one of said clockwise direction and counterclockwise direction, whereby said selected stop lever is bent, thereby changing the position of said first stop lever and said second stop lever; and removing said tool from said selected stop lever.

* * * * *

UNITED STATES PATENT AND TRADEMARK OFFICE

CERTIFICATE OF CORRECTION

PATENT NO. : 5,163,401

DATED : November 17, 1992

INVENTOR(S) : Paul T. Reese

It is certified that error appears in the above-identified patent and that said Letters Patent is hereby corrected as shown below:

Claim 2, Column 7, Line 56, Delete "spaced" and insert therefor --speed--.

Claim 4, Column 8, Line 2, Delete "ink" and insert therefor --link--.

Signed and Sealed this

Fifth Day of October, 1993

*Attest:*

*Attesting Officer*

Bruce Lehman

BRUCE LEHMAN

*Commissioner of Patents and Trademarks*